US011448067B2

(12) United States Patent
Himmelsbach

(10) Patent No.: US 11,448,067 B2
(45) Date of Patent: Sep. 20, 2022

(54) CUTTING TOOL FOR A TUNNEL BORING MACHINE AND A TUNNEL BORING MACHINE

(71) Applicant: HERRENKNECHT AKTIENGESELLSCHAFT, Schwanau (DE)

(72) Inventor: Christian Himmelsbach, Schwanau (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 189 days.

(21) Appl. No.: 16/772,429

(22) PCT Filed: Jan. 16, 2019

(86) PCT No.: PCT/EP2019/051036
§ 371 (c)(1),
(2) Date: Dec. 7, 2020

(87) PCT Pub. No.: WO2019/145201
PCT Pub. Date: Aug. 1, 2019

(65) Prior Publication Data

US 2022/0145757 A1 May 12, 2022

(30) Foreign Application Priority Data

Jan. 23, 2018 (DE) ..... 20 2018 100 361.5

(51) Int. Cl.
*E21D 9/00* (2006.01)
*E21D 9/10* (2006.01)
(Continued)

(52) U.S. Cl.
CPC ..... *E21D 9/003* (2013.01); *E21D 9/087* (2013.01); *E21D 9/104* (2013.01); *E21D 9/112* (2013.01); *E21D 9/115* (2013.01)

(58) Field of Classification Search
CPC ..... E21D 9/003; E21D 9/08; E21D 9/087; E21D 9/0874; E21D 9/104; E21D 9/11;
(Continued)

(56) References Cited

U.S. PATENT DOCUMENTS

2008/0002400 A1 1/2008 Huang
2008/0024000 A1 1/2008 Moulin et al.
(Continued)

FOREIGN PATENT DOCUMENTS

CN 105486216 4/2016
CN 105973896 9/2016
(Continued)

OTHER PUBLICATIONS

International Search Report and Written Opinion dated Apr. 24, 2019 in PCT Application No. PCT/EP2019/051036.

*Primary Examiner* — Abby J Flynn
*Assistant Examiner* — Michael A Goodwin
(74) *Attorney, Agent, or Firm* — Faegre Drinker Biddle & Reath LLP

(57) ABSTRACT

A cutting tool for a tunnel boring machine, including a tool head equipped with a wear sensor detachably connectable to a tool holder. A line arrangement having a wireless, connector-free coupling module between the tool head and the tool holder is provided for connecting the wear sensors to an evaluation module. In the event of wear, a tool head to be replaced may be removed from the tool holder and a new tool head may be connected to the tool holder.

10 Claims, 4 Drawing Sheets

(51) Int. Cl.
*E21D 9/087* (2006.01)
*E21D 9/11* (2006.01)

(58) Field of Classification Search
CPC ..... E21D 9/112; E21D 9/113; E21D 9/115; E21B 12/02; E21C 39/00
USPC ..... 299/1.8
See application file for complete search history.

(56) References Cited

U.S. PATENT DOCUMENTS

| | | | | |
|---|---|---|---|---|
| 2009/0297273 | A1* | 12/2009 | Lindbergh | G01P 3/22 702/9 |
| 2012/0086260 | A1* | 4/2012 | Hanaoka | E21D 9/112 299/112 R |
| 2013/0270890 | A1* | 10/2013 | Hall | E21C 35/18 299/79.1 |
| 2014/0232167 | A1* | 8/2014 | Edelmann | E21D 9/003 73/514.39 |
| 2017/0159432 | A1* | 6/2017 | Lavely | E21C 35/18 |
| 2018/0171568 | A1* | 6/2018 | Laclef | E21C 35/18 |
| 2020/0088617 | A1* | 3/2020 | Marquez Llinas | E02F 9/2816 |

FOREIGN PATENT DOCUMENTS

| | | | |
|---|---|---|---|
| CN | 206053959 | | 3/2017 |
| JP | 61-184905 | U | 11/1986 |
| JP | 04-12585 | U | 1/1992 |
| JP | 04-63008 | U | 5/1992 |
| JP | 06-193389 | A | 7/1994 |
| JP | 11-131980 | A | 5/1999 |
| JP | 2000-204884 | A | 7/2000 |

* cited by examiner

CUTTING TOOL FOR A TUNNEL BORING MACHINE AND A TUNNEL BORING MACHINE

CROSS-REFERENCE TO RELATED APPLICATION

This application is a U.S. National Phase Patent Application based on International Application Serial No. PCT/EP2019/051036, filed Jan. 16, 2019, the disclosure of which is hereby explicitly incorporated by reference herein.

BACKGROUND OF THE INVENTION

1. Field of the Invention

The invention relates to a cutting tool for a tunnel boring machine, and further relates to a tunnel boring machine that is equipped with at least one tool of this type.

2. Description of the Related Art

One known cutting tool for a tunnel boring machine and a tunnel boring machine that is equipped with a number of such cutting tools are disclosed in JP 2000-204884 A.

The previously known cutting tool for a tunnel boring machine has a tool head into which a wear sensor is integrated. The wear sensor may be acted on with electrical energy via a wired electrical line arrangement. The cutting tool is also equipped with a tool holder to which the tool head is exchangeably connected. In the previously known cutting tool, the wear sensor is formed by a number of spaced-apart wires with their ends staggered in a wear direction, and that are led out of the cutting tool in a hard-wired manner.

What is desired is an improvement over the foregoing.

SUMMARY OF THE INVENTION

The present invention provides a cutting tool and a tunnel boring machine equipped with same, wherein simple replacement of the cutting tool is provided when a wear limit is reached.

As the result of the cutting tool according to the invention having a wireless, connector-free coupling module, and the line arrangement thus being very easily disconnectable between the tool head and the tool base when a worn tool head is replaced and subsequently reconnectable, the tool head may be replaced very easily when it is recognized via the evaluation module, situated in the immediate vicinity of the tool holder, that a wear limit has been reached.

Further advantageous embodiments and advantages of the invention result from the following description of one exemplary embodiment, with reference to the figures of the drawing.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DETAILED DESCRIPTION

Figure 1:
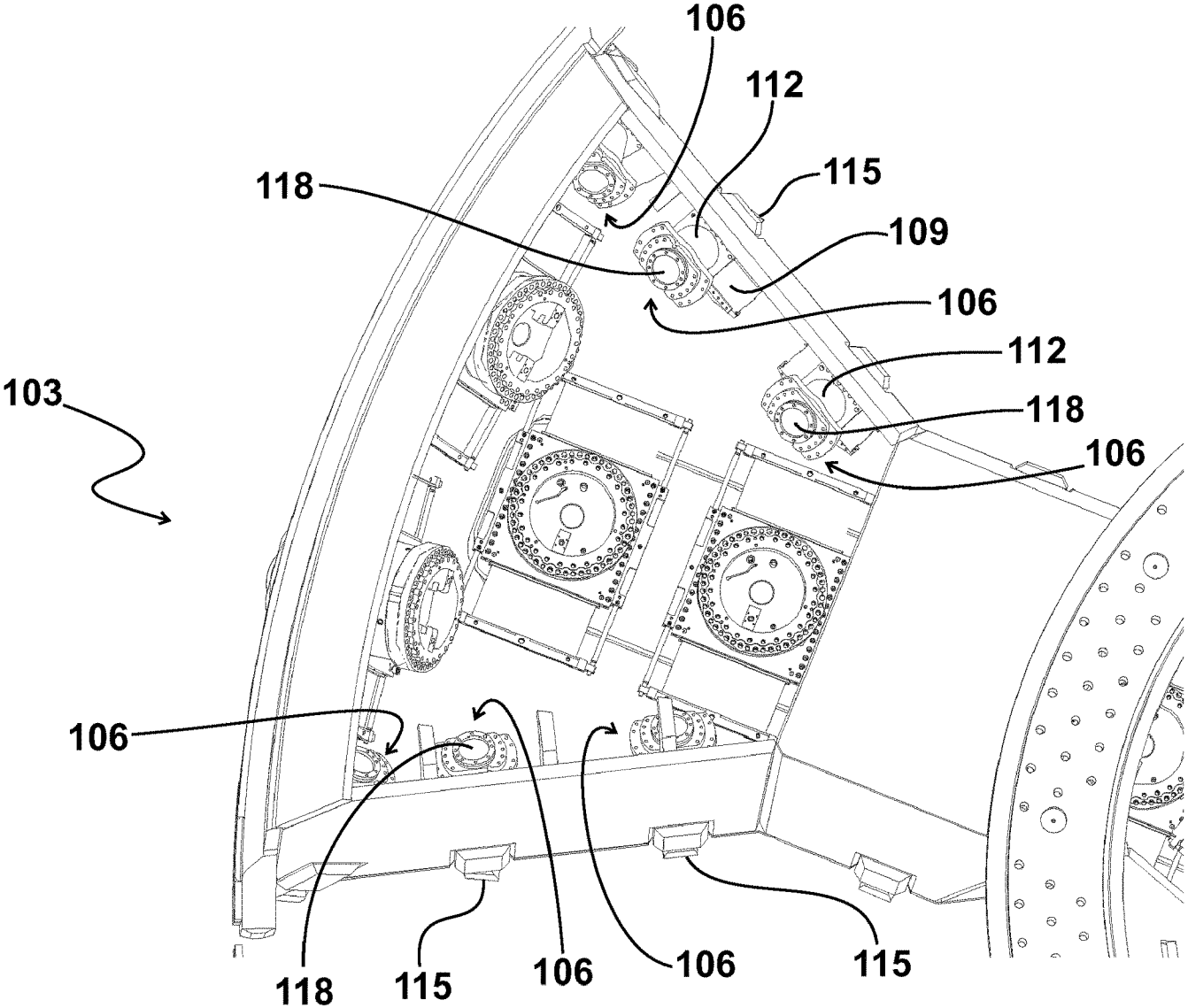
FIG. 1 shows a graphical perspective illustration of a detail of a cutting wheel of a tunnel boring machine that is equipped by way of example with cutting tools according to the invention.

FIG. 1 shows a simplified perspective illustration of a detail of a cutting wheel 103 of a tunnel boring machine, which in the present case is equipped with a number of cutting tools 106 according to the invention, illustrated in one exemplary embodiment and designed here as so-called scraper blades for removing soft rock and unconsolidated rock. Each cutting tool 106 is displaceably situated in a carrier head 109 that is connected to the cutting wheel 103, an elongated end sleeve 112 being mounted on the rear side of the carrier head facing away from an excavation side. On the excavation side, for removal of approaching geological structures each cutting tool has a scraper blade head 115, which during excavation operation of the tunnel boring machine is subjected to wear, and which for economic reasons should therefore be replaced in a preferably quick and operationally reliable manner when the wear level is at or below a predetermined wear limit.

On the side facing away from the scraper blade head 115, each cutting tool 106 is provided with a sightglass disc 118 that closes off the cutting tool 106 at the rear and that is transparent so that it may transmit visual information that is detectable by the human eye.

Figure 2:
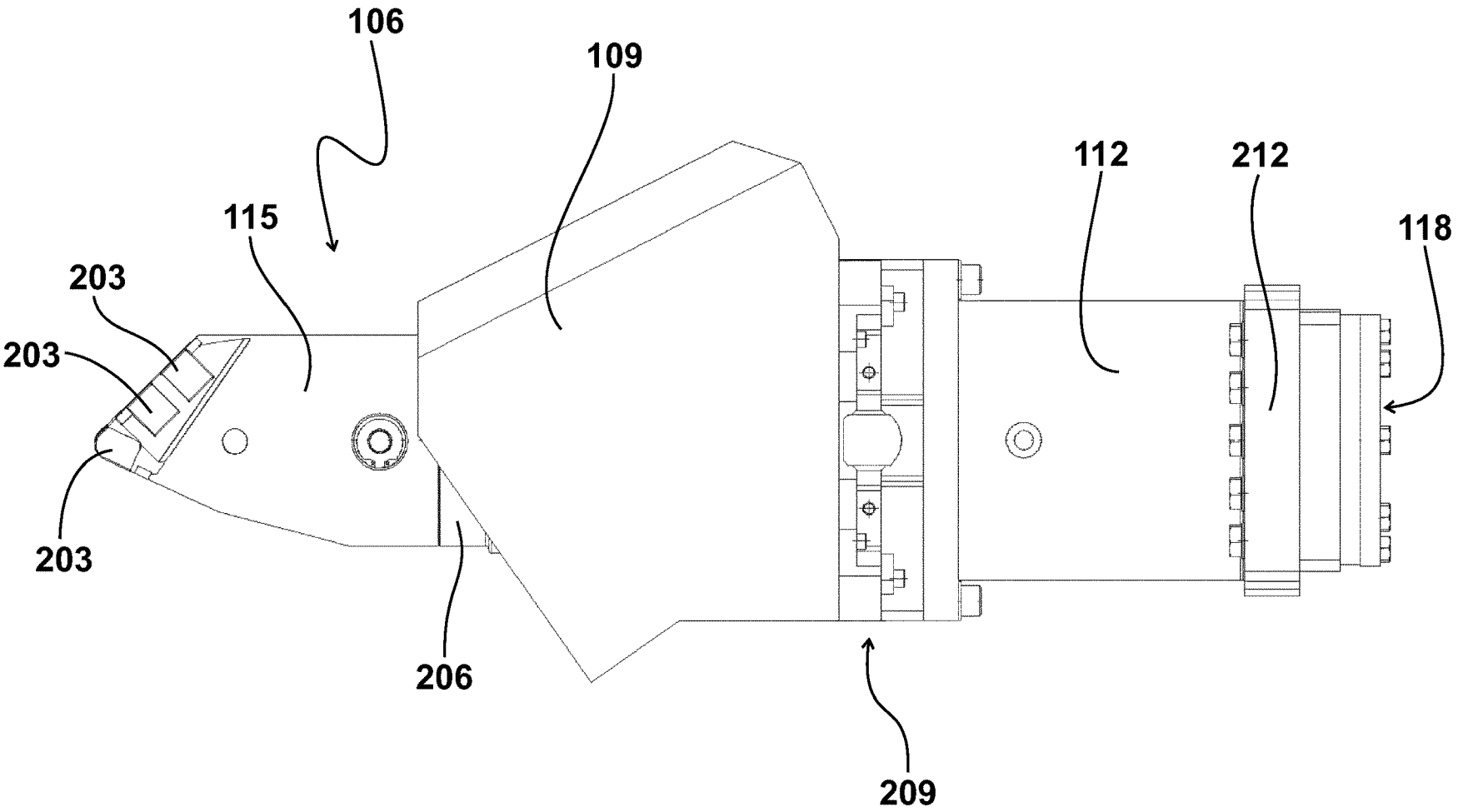
FIG. 2 shows a side view of one exemplary embodiment of a cutting tool according to the invention situated in a carrier head, in an extended operating position.

FIG. 2 shows a side view of the exemplary embodiment of an example of a cutting tool 106 according to FIG. 1, mounted in a carrier head 109. It is apparent from FIG. 2 that the scraper blade head 115 on the excavation side is fitted with a number of hard inserts 203 in order to optimize the service life until the wear limit is reached. It is also apparent from the illustration according to FIG. 2 that the scraper blade head 115 is connected to a tool holder head 206 which, in the extended operating position illustrated in FIG. 2, extends from the scraper blade head 115 into the carrier head 109.

The end sleeve 112 with its end facing the carrier head 109 is detachably connected to the carrier head 109 via a connecting flange ring arrangement 209 by means of screw connections, while the free end of the end sleeve 112 facing away from the carrier head 109 bears a closing flange ring 212 in which the rear end of the cutting tool 106 opposite from the scraper blade head 115 is displaceably supported.

Figure 3:
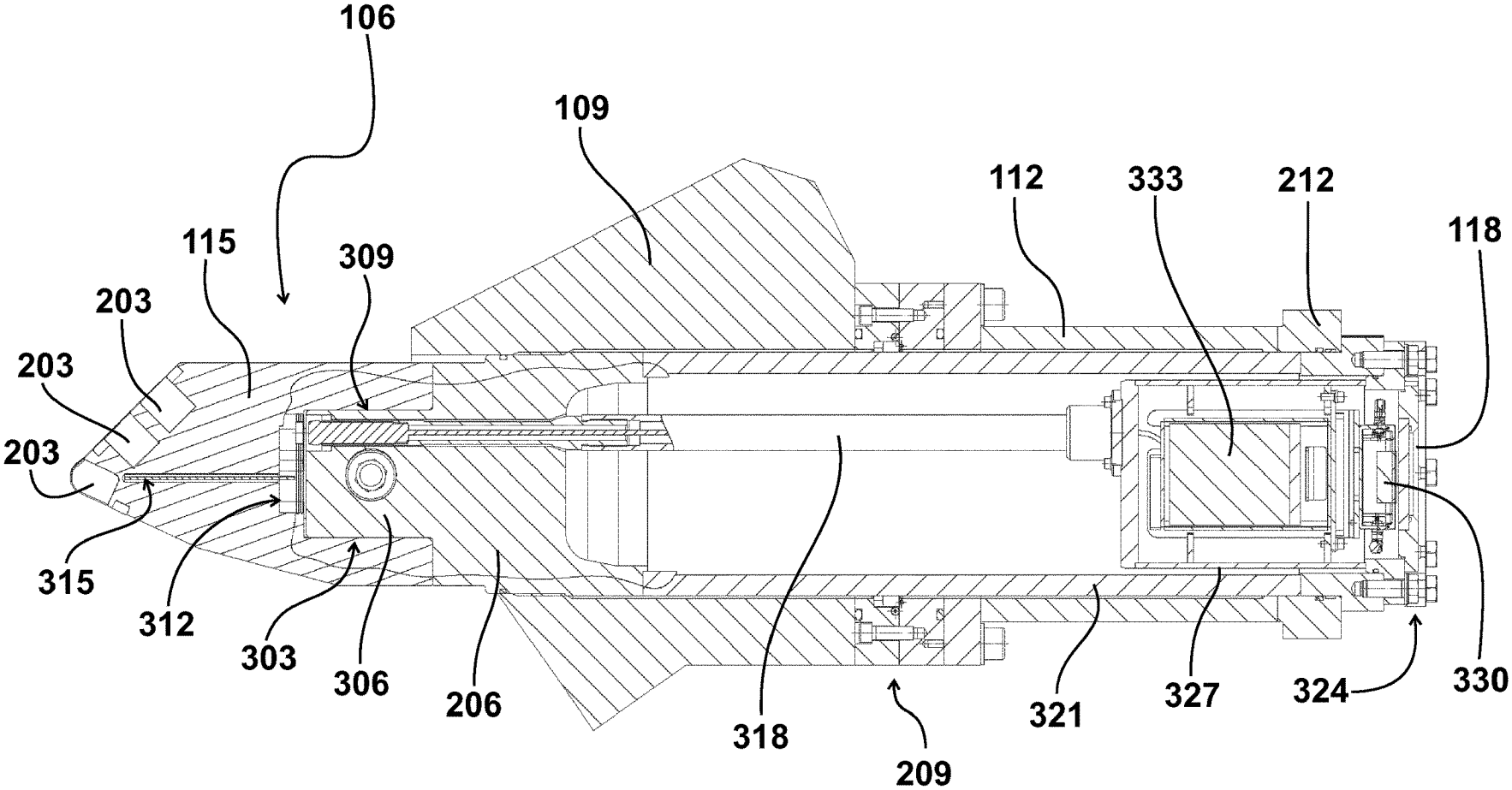
FIG. 3 shows a sectional view of a longitudinal section of the arrangement according to FIG. 2.

FIG. 3 shows a sectional view of a longitudinal section of the arrangement according to FIG. 2, with the cutting tool 106 in the extended operating position. It is apparent from FIG. 3 that the scraper blade head 115 and the tool holder head 206 are connected to one another via a form-fit mortise and tenon joint 303, which in this exemplary embodiment has a polygonal stump 306 and a polygonal stump receptacle 309, with a design that is complementary to the polygonal stump 306, which engage with one another with a precise fit.

Alternatively, a cylindrical stump and a cylindrical stump receptacle with separate anti-twist protection are used for the mortise and tenon joint 303.

A coupling module 312 of a line arrangement is present in the area of the end-face contact point between the polygonal stump 306 and the polygonal stump receptacle 309, and provides a wireless, connector-free interface, preferably formed by spaced-apart transmitter/receiver elements, between a portion of the line arrangement situated in the scraper blade head 115 and a portion of the line arrangement extending from the coupling module 312 on the side of the cutting tool 106 facing away from the scraper blade head 115.

The scraper blade head 115 is equipped with wear sensors 315, for example in the form of temperature sensors, which deliver output signals that are characteristic for the instantaneous state of wear of the scraper blade head 115, and that may be supplied to the line arrangement and led from the scraper blade head 115 via the coupling module 312.

The line arrangement also has a line guide tube 318, which at one end is passed through the tool holder head 206 up to the coupling module 312 and extends away from the tool holder head 206. Coupling module 312 may include an inductive coupling. The line guide tube 318 is situated in the interior of a tool holder base 321 that has a hollow cylinder-like design and is connected to the tool holder head 206; mounted on the end of the tool holder base facing away from the tool holder head 206 is a closing flange ring arrangement 324 to which the sightglass disc 118, among other things, is fixed. In addition, situated on the end of the tool holder base 321 facing away from the tool holder head 206 is a protective housing 327 in which an evaluation module 330 is situated, which in this exemplary embodiment is equipped with a visual state of wear display.

The end of the line guide tube 318 facing away from the tool holder head 206 opens into the protective housing 327, so that the line arrangement is connected to the evaluation module 330, largely protected from external, in particular mechanical, influences.

This ensures that the output signals of the or each wear sensor 315 act on the evaluation module 330, which is advantageously supplied with electrical energy via a dedicated power supply module 333, such as a preferably rechargeable battery, that is situated in the protective housing 327, and the state of wear display, for example in the form of a green light display for a still operational state of the scraper blade head 115 prior to reaching a predetermined wear limit, and a red display when the wear level of the scraper blade head 115 is at or below the wear limit, is observable through the sightglass disc 118 by operation and maintenance personnel.

In one refinement that is not illustrated, the data signals supplied to the state of wear display may alternatively or additionally be transmitted, via a transmitting unit of the evaluation module 330 by means of a wireless transmission channel such as a radio connection, into a rear area of the tunnel boring machine on the excavation side, for example the control console thereof, and further processed there.

It is apparent from FIG. 3 that the overall design of the cutting tool 106 is highly stable mechanically, and the electrical and electronic components are very well encapsulated from external environmental influences such as in particular moisture in the interior of the tool holder base 321, or mechanical effects.

It is also apparent from FIG. 3 that the advance of the cutting tool 106 for assuming the operating position is limited by stops that are formed in the radial direction between the closing flange ring 212 and the closing flange ring arrangement 324, and between the carrier head 109 and the tool holder head 206.

Figure 4:
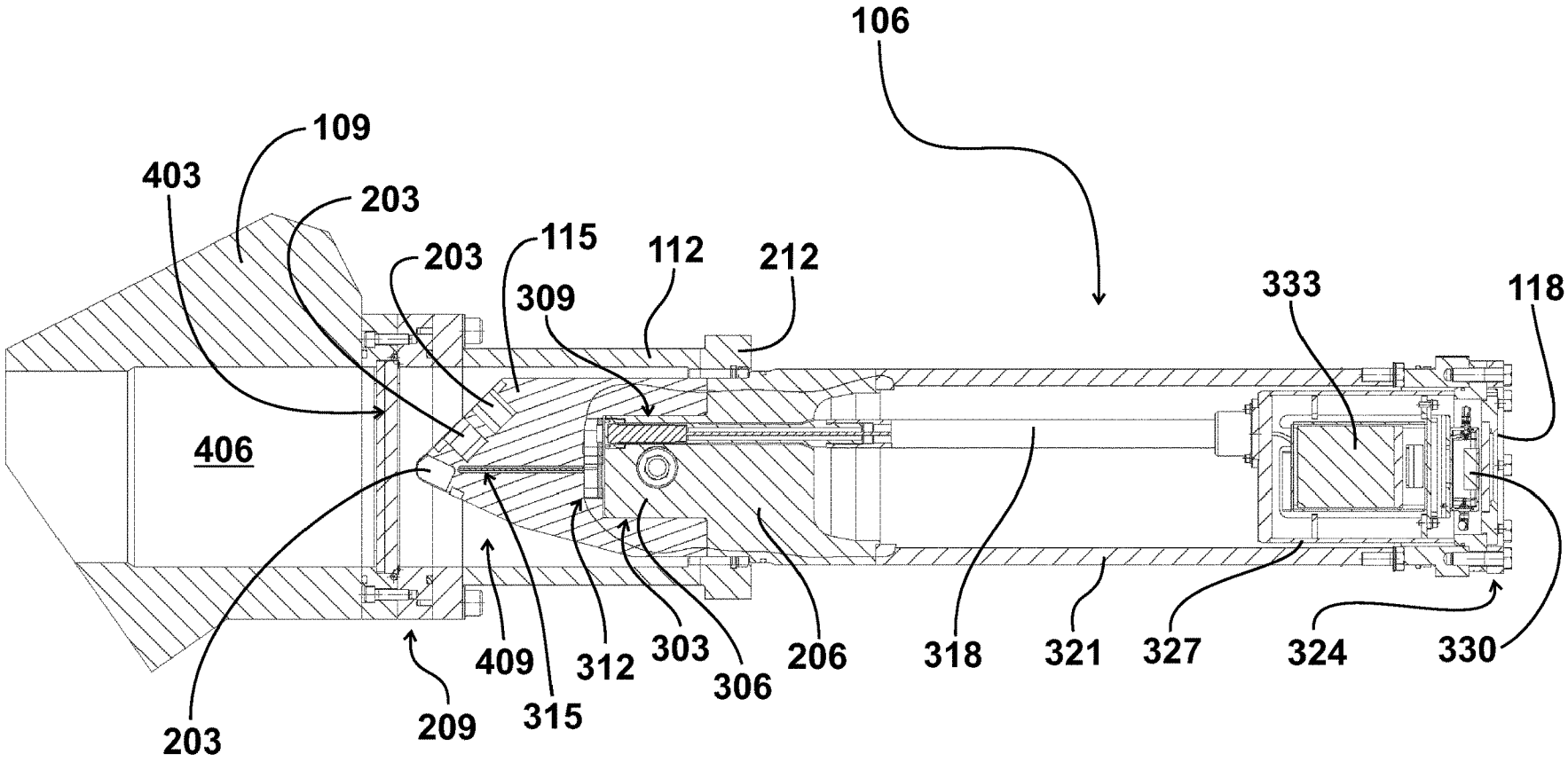
FIG. 4 shows a sectional view of a longitudinal section of the example of a cutting tool according to FIG. 3, in a retracted maintenance position.

FIG. 4 shows a sectional view of the cutting tool 106 in the longitudinal direction corresponding to FIG. 3, in a maintenance position, which is retracted compared to the operating position according to FIG. 3, in which the cutting tool 106 is withdrawn from the carrier head 109 and is ready for complete removal from the end sleeve 112. It is apparent from the illustration according to FIG. 4 that the connecting flange arrangement 209 holds a closure unit 403 via which a receiving space 406, formed in the carrier head 109 for the cutting tool 106 on the excavation side, may be separated from a guide space 409 of the end sleeve 112. It is thus possible to remove the cutting tool 106, without pressure, in a closed position of the closure unit 403. Then, for example, a worn scraper blade head 115 may be removed from the tool holder head 206 and an unworn scraper blade head 115 may be refastened to the tool holder head 206, with no complicated or error-prone connection operations on the line arrangement.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A cutting tool for a tunnel boring machine, comprising:

a tool head including a wear sensor integrated into the tool head, the tool head further held by a tool holder removably connected to the tool head;

an electrical line arrangement electrically connected to the wear sensor and extending from the tool head to an end of the tool holder facing away from the tool head, the line arrangement including a wireless, connector-free coupling module disposed between the tool head and the tool holder, and an evaluation module disposed on the end of the tool holder facing away from the tool head; and wherein the evaluation module includes a visual wear display.

2. The cutting tool of claim 1, wherein the coupling module includes an interface having spaced-apart transmitter/receiver elements.

3. The cutting tool of claim 1, wherein the coupling module includes an inductive coupling.

4. The cutting tool of claim 1, wherein the line arrangement includes a first electrical line connecting the wear sensor to the coupling module, and a second electrical line connecting the coupling module to the evaluation module that controls a state of wear display.

5. The cutting tool of claim 1, wherein the tool holder includes a tool holder head connectable to the tool head via a form-fit, and a tool holder base having a hollow cylinder disposed on a side of the tool holder head facing away from the tool head, the evaluation module disposed on an end of the tool holder base facing away from the tool holder head.

6. The cutting tool of claim 1, wherein the line arrangement includes a section disposed in a line guide tube, the line guide tube positioned in an interior of the tool holder base.

7. The cutting tool of claim 1, wherein the evaluation module is disposed in a protective housing, the protective housing also containing a power supply module.

8. The cutting tool of claim 1, wherein data generated by the evaluation module is transmittable via a wireless transmission channel via the evaluation module.

9. A tunnel boring machine comprising at least one cutting tool of claim 1.

10. The tunnel boring machine of claim 9, wherein:

each cutting tool is displaceably positioned in an associated carrier head; and each carrier head has a closure unit which, in a retracted position of the cutting tool associated with the carrier head, is closeable to close an area of the tunnel boring machine facing away from a working face against the working face in a pressure-tight manner.

* * * * *